United States Patent [19]

Ritter

[11] Patent Number: 4,937,994

[45] Date of Patent: Jul. 3, 1990

[54] COUNTER CEILING COMPRISING A SUSPENDED SUPPORTING SKELETON

[76] Inventor: Albrecht Ritter, Scheibbserstrasse 119, D-7255 Rutesheim, Fed. Rep. of Germany

[21] Appl. No.: 234,557

[22] Filed: Aug. 22, 1988

[30] Foreign Application Priority Data

Jan. 27, 1988 [DE] Fed. Rep. of Germany ..... 3802309

[51] Int. Cl.[5] ..... E04B 5/55; E04B 5/57

[52] U.S. Cl. ..... 52/488; 52/484; 52/489; 52/665; 52/666; 52/772; 52/774; 52/775

[58] Field of Search ..... 52/488, 489, 772, 773, 52/774, 775, 484, 665, 666

[56] References Cited

U.S. PATENT DOCUMENTS

| | | | |
|---|---|---|---|
| 2,178,507 | 10/1939 | Williams | 52/773 |
| 3,202,077 | 8/1965 | Lee | 52/484 |
| 3,275,817 | 9/1966 | Schwartz et al. | 52/484 |
| 3,327,438 | 6/1967 | Cooper | 52/484 |
| 3,329,387 | 7/1967 | Fischer | 52/484 |
| 3,596,425 | 8/1971 | Kodaras . | |
| 3,677,589 | 7/1972 | Poles | 52/665 |
| 3,685,235 | 8/1972 | Lang | 52/484 |
| 3,798,865 | 3/1974 | Curtis | 52/484 |
| 4,663,911 | 5/1987 | Gracia | 52/665 |

FOREIGN PATENT DOCUMENTS

| | | | |
|---|---|---|---|
| 472698 | 4/1975 | Australia | 52/489 |
| 533536 | 12/1954 | Belgium | 52/772 |
| 8709026 | 10/1987 | Fed. Rep. of Germany . | |
| 1281949 | 12/1961 | France | 52/774 |
| 1527839 | 4/1968 | France | 52/773 |
| 2191000 | 2/1974 | France . | |
| 2444781 | 8/1980 | France | 52/773 |
| 403258 | 6/1966 | Switzerland | 52/774 |

*Primary Examiner*—Michael Safavi
*Attorney, Agent, or Firm*—Darby & Darby

[57] ABSTRACT

In the case of a counter-ceiling comprising a suspended supporting skeleton consisting of intersecting longitudinal and transverse supporting rails of substantially T-shaped cross-section, it is proposed to implement the joints between the rails at the points of intersection by providing that the T-shaped section of each supporting rail comprises a longitudinal hollow space in the vertical main web, and by inserting the central mounting web of separate connection elements of likewise T-shaped configuration into the longitudinal hollow space of a first supporting rail, and fastening at least one of the base webs of the connection elements at the outside of the vertical main web or a perpendicularly extending supporting rail.

18 Claims, 4 Drawing Sheets

COUNTER CEILING COMPRISING A SUSPENDED SUPPORTING SKELETON

BACKGROUND OF THE INVENTION

The present invention relates to a counter-ceiling comprising a suspended supporting skeleton according to the preamble of claim 1. It has been known before in connection with clean rooms, laboratories, medical rooms, and the like, to install so-called counter-ceilings consisting of a suspended supporting skeleton formed by longitudinal supporting rails and transverse supporting rails (see, for example, DE-GM 19 95 158). In the case of this known counter-ceiling, where—besides—the supporting rails and the coffers inserted between the latter consist of, or are encased by a fire-resistant material, connection elements are provided whose ends are inserted into two mutually aligned transverse supporting rails while a central portion thereof overlaps the longitudinal supporting rail crossing the two transverse supporting rails. There is no possibility of mutually bracing the supporting rails forming the supporting skeleton and the connection elements so that the longitudinal and transverse rails are permitted to turn relative to each other—a phenomenon which may occur, for example, when the individual panels are loaded differently.

It is of importance for such counter-ceilings, in particular if they are intended for use in clean rooms or for medical purposes, that they must be tight, i.e. that the transverse and longitudinal supporting rails must abut flush against each other at the crossing points. In addition, it is desired that such counter-ceilings should be suited for being walked on so that bracing means are provided in the connection area at the crossing points of the supporting rails for connecting and bracing the rails with each other.

A known counter-ceiling of this type (DE-PS 28 09 674) uses for both, the longitudinal and transverse supporting rails, an identical inverse T-shaped section consisting of a vertical web and horizontal flange extending on both sides from the bottom of the web.

In order to enable such supporting rails to be interconnected, the solid vertical web is provided with thicker portions at different heights, a first thicker portion provided in the area of transition to the horizontal basic flanges comprising a laterally open longitudinal groove while another thicker portion provided on the other, remote end of the vertical web comprises an upwardly open longitudinal groove. These longitudinal grooves, in any case the upper, upwardly open longitudinal groove provided at the end of the vertical web, serve for receiving threaded rods which extend through a transverse groove, for example in a longitudinal supporting rail, and through an additional transverse bore provided therein and are fixed in place in the transverse supporting rails by screws mounted on both sides. To this end, slots which must be accessible from above must be provided in the upper thicker portion of each of the transverse supporting rails.

In order to enable the longitudinal and transverse supporting rails abutting each other to be connected also in the lower area, fitting pins or splined pins are inserted into the lower longitudinal channels provided at this point so that the longitudinal and transverse supporting rails are secured against rotation relative to each other.

The suspension of the supporting rails is effected by additional suspension brackets exhibiting an almost closed U-shape with transverse, inwardly directed legs engaging longitudinal grooves provided on both sides of the supporting rail, every two such suspension brackets supporting two sides of a metal plate provided with a threaded hole for receiving a threaded supporting rod which is in turn fixed to the raw ceiling.

It has been further known in this connection (DE-PS 32 47 506) to provide special leaf-spring clamps for biassing resiliently the coffers resting on the horizontal flanges of each rail. These leaf-spring clamps embrace the vertical web of the T section from above, engage lateral longitudinal grooves provided in the web and bear at a certain pressure against the edges of the mounted coffers, by means of outwardly projecting resilient legs.

The known counter-ceiling, which is insofar tight and also suitable for being walked on, exhibits a complex design and may present certain problems regarding the fixation at the raw ceiling by means of leaf-spring clamps. In addition, it is a problem that at the point where a bracing effect between the transverse and the longitudinal supporting elements is needed, no screw connections, but only set pins preventing relative rotation, are provided so that there is a risk that the ceiling may yield in downward direction when being walked on.

Another problem resides in the fact that although the longitudinal and the transverse supporting rails have an identical basic shape, the transverse supporting rails have to be processed and prepared additionally in order to obtain a continuous, flush underside of the supporting skeleton and to achieve a continuous and tight supporting surface for the coffer around the whole panel. To this end, the horizontal flanges must be cut off at the ends of the transverse supporting rails over a certain length to ensure that the end face of the respective vertical web can rest flush against the side of the vertical web of a supporting rail extending perpendicularly thereto. However, it is rather difficult to carry out this work with the required precision during assembly. While it would be possible to avoid this problem by differentiating from the very beginning between longitudinal supporting rails and transverse supporting rails, this would in turn render the stock-keeping and transport operations more complex.

Now, it is the object of the present invention to provide a counter-ceiling with a suspended supporting skeleton which, while being tight and suited for being walked on, exhibits a simple structure and is easy to assemble and which does not require any additional processing of the section elements in order to prepare them for use as longitudinal or transverse supporting rails, while on the other hand the whole skeleton can be rigidly braced on all sides.

ADVANTAGES OF THE INVENTION

The counter-ceiling according to the invention solves this problem with the aid of the characterizing features of the main claim and provides the advantage that any torsion between longitudinal and transverse supporting rails relative to each other is excluded from the very beginning by a separate connection element of T-shaped configuration and of a size approximately in the order of the rail section itself, the central mounting web of the connection element being introduced into the longitudinal hollow space of a first supporting rail, which is to be joined flush to another rail, to provide a connection which is free from torsion and tilting. The two base webs of the T-shaped connection section, or at least one of these base webs, are then fixed to the vertical main web of the supporting rail extending perpendicularly thereto, for example by means of screws, in which case the connection between the webs may be secured by a transverse bolt.

This leads directly to a flush joint between the longitudinal and the transverse supporting rails, in the area of their lower horizontal webs, it being of course a fact that in this case the vertical main webs cannot be in direct contact with each other. In the case of the present invention, the resulting spacing is, however, bridged by a portion of the central mounting web of the connection element. This portion may be of thicker design and may in this case directly constitute the continuation of the vertical main web of one transverse supporting rail so that a direct connection is obtained between the latter and the vertical main web of one longitudinal supporting rail (or vice versa). This permits on the one hand to obtain a flush joint between the horizontal lower supporting webs of each rail section, which serve preferably for supporting coffers or the like, without the need to carry out any sawing or milling operations. In addition, this arrangement also enables such a flush joint to be obtained in the area of the vertical main webs, in which case the existing space is bridged by means of the separate connection element. The height of the separate connection element is selected in such a manner that its central mounting web and the base webs extending therefrom on both sides fit between the contact surfaces of the general rail section. To say it in other words: the function of the offsets or recesses generally required in all cases where a T section is to be connected with another by a flush joint is performed in this case by the different height dimensions of the separate connection element.

Another advantage of the invention is seen in the fact that the rail section is given a particularly high strength by the double-walled design of its vertical main web which makes it possible to have additional connection means, for example screws, screwed into the rail section from below, the main web area of the rail section offering a sufficient width for this purpose. It is, therefore, possible to have additional fixtures, such as lamps, fans, or the like, suspended from the counter-ceiling at desired predetermined points.

Another particular advantage of the present invention is seen in the fact that the base webs (on both sides) of each separate connection element can be screwed at the top and at the bottom (viewed over their height) to the vertical main web of a perpendicularly extending rail section, and this preferably at predetermined points, so that corresponding threaded bores can be prepared, also on the corresponding base webs, already in the factory. These screw connections enable each transverse rail, whose vertical main web accommodates in its longitudinal hollow space the mounting web of a connection element which is fastened therein in a convenient manner, preferably by bolting, to be drawn close to the corresponding longitudinal supporting rail and braced thereto (or vice versa) so that the arrangement will remain tight under any conditions, even when the counter-ceiling is walked upon, i.e. when pressure is exerted on the counter-ceiling from above. In this case, the screw connections effected using the connection elements, and the bolted connections between the latter and the corresponding perpendicularly extending rail sections, prevent the ceiling from opening in downward direction.

The features specified in the sub-claims permit certain advantageous improvements and developments of the counter-ceiling specified by the main claim. According to a particularly advantageous feature, the upper end portion of the vertical main web has a double U-shaped configuration so that corresponding nuts or the like can be introduced (and moved to a predetermined position, as desired) into the preferably rectangular, but upwardly open hollow space which is formed by this configuration in this area, too. It is then only necessary to screw corresponding threaded suspension rods mounted on the raw ceiling into these nuts from above. This enables each rail section to be connected with the raw ceiling without any additional intermediate clamping elements and gives the suspension as a whole improved rigidity and safety.

BRIEF DESCRIPTION OF THE DRAWING

Certain embodiments of the invention will now be described in more detail with reference to the drawing in which.

DESCRIPTION OF THE EMBODIMENTS

It is the basic idea of the present invention that the T section of each supporting rail is given a double-walled design comprising an inner hollow space in the area of the vertical main web and that a likewise T-shaped fastening rail is provided as a separate mounting element for establishing flush joints between the longitudinal and the transverse rails, the central mounting web of this rail being arranged for being introduced into the hollow space of the supporting rail and fixed, preferably screwed, to the outer surfaces of the vertical main web. This arrangement solves simultaneously quite a number of problems in that it combines altogether favorable production and assembly costs with a simple structure and safe assembly, while insuring on the other hand tight connections of the counter-ceilings combined with a high load-carrying capacity (promenade ceilings).

Figure 1:
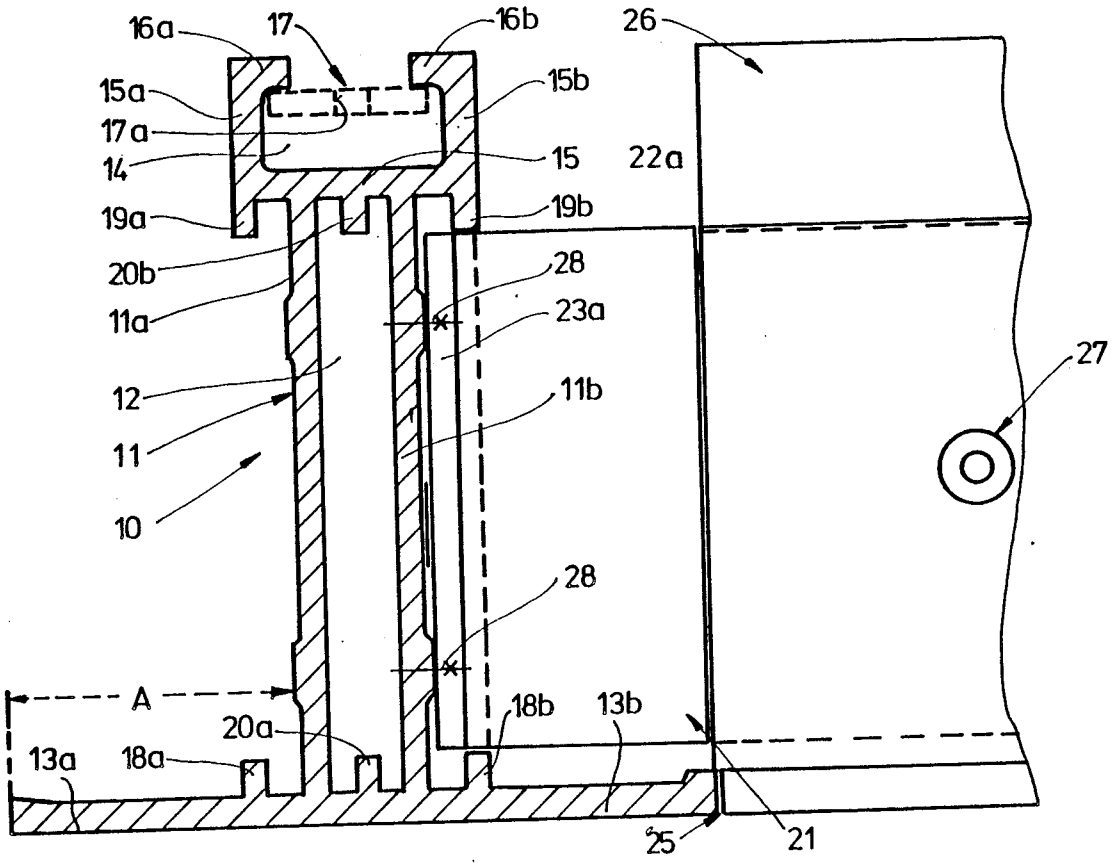
FIG. 1 shows a diagrammatic cross-section illustrating the basic shape of the rail section which is used for both, the longitudinal and the transverse supporting rails, and of another supporting rail mounted laterally on such basic rail by means of a connection element.

FIG. 1 illustrates the basic profile of the supporting rail 10, which may be described as longitudinal or transverse rail. The general basic shape of the supporting rail is such that the vertical main web 11 forms an inner hollow space 12 of, for example, rectangular cross-section, i.e. consists of two walls or partial webs 11*a*, 11*b* extending parallel to each other.

This simple basic shape of the supporting rail is supplemented by supporting webs 13*a*, 13*b* provided on both sides at the bottom (in the drawing plane and also in the preferred installed position) of the vertical main web 11, while at the top the vertical main web 11 ends in an upwardly open hollow section 14 of likewise rectangular shape.

The hollow section 14 is obtained by the fact that the two parallel partial webs 11*a*, 11*b* are covered on top by a horizontal end plate 15 of a width greater than that of the vertical main web, which completes the longitudinal hollow space 12. The end plate 15 carries legs 15*a*, 15*b* which extend vertically upwardly therefrom and which are in turn provided with inwardly directed shorter projections 16*a*, 16*b*.

This makes it possible to insert into this hollow section 14 a nut indicated at 17 (secured against torsion), which can be displaced in the longitudinal direction and whose thread 17*a* (not shown in the drawing) can receive a threaded mounting rod to be fixed to the raw ceiling.

Both the lower supporting webs 13*a* and 13*b* and the two vertical webs 15*a*, 15*b* are provided each with short web sections 18*a*, 18*b* or 19*a*, 19*b*, respectively, which are directed towards each other so that laterally open U-shaped spaces—which will be described in more detail further below—are obtained on both sides. That is, for example, element 18*a* and web 11*a* define a U-shaped space in profile and element 19*a* and web 11*a* define another U-shaped space whereby the U-shaped spaces are opposed to each other. In addition, shorter vertical webs 20*a*, 20*b* directed towards each other may be provided inside the hollow longitudinal space 12.

Figure 2:
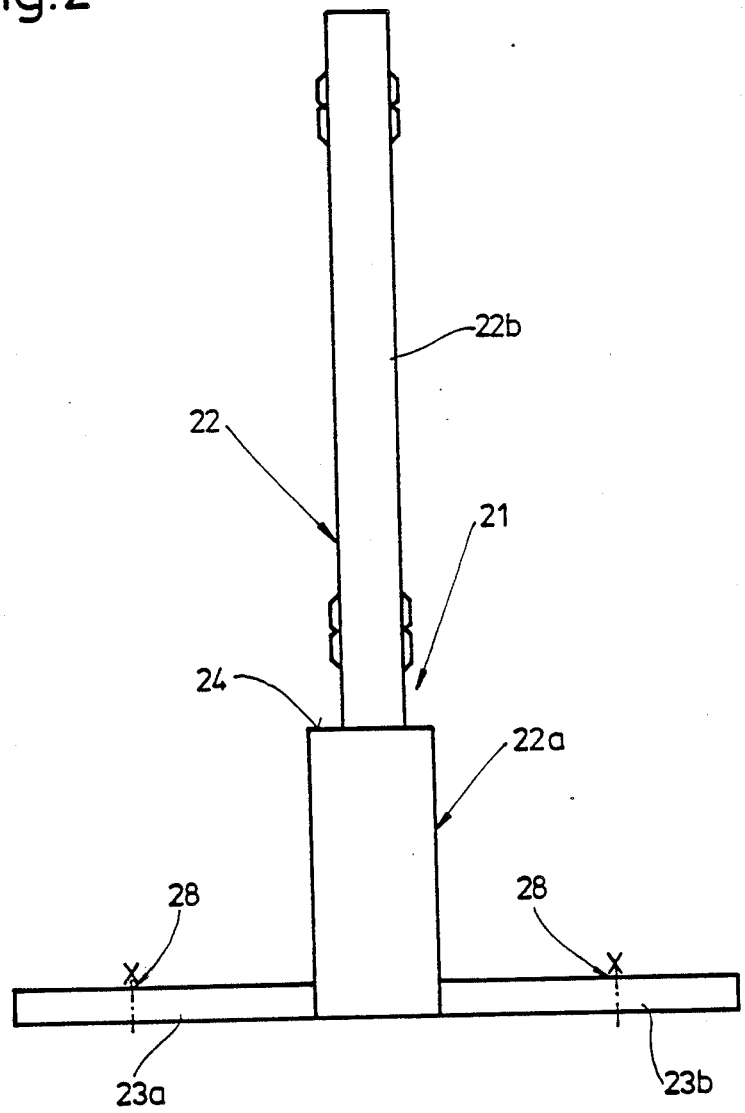
FIG. 2 shows a top view of a connection element.

The corner connection member generally described as connection element 21, which is illustrated in FIG. 2, is adapted to this basic shape of the supporting rail which is used for both, the longitudinal and transverse supporting rail. The connection element 21, too, exhibits a basically T-shaped configuration comprising a central mounting web 22 and two lateral base webs 23*a*, 23*b*. Starting from the base webs 23*a*, 23*b* projecting on both sides, the central mounting web 22 exhibits a thicker rectangular shape 22*a* followed, at a predetermined distance from the base webs, by a shoulder or a stop face 24 forming the transition to a narrower shape 22*b* of the mounting web. The thickness of the narrower portion 22*b* corresponds approximately to the width of the inner longitudinal hollow space of the rail section, while the distance of the shoulder 24 from the bottom surface of the base webs corresponds approximately to the distance A between the end of each lateral supporting web 13*a*, 13*b* and the vertical main web 11.

One realizes easily why this particular configuration has been selected if one regards the joints between intersecting longitudinal and transverse rails. Before going into the details of this aspect, it should however be noted in addition that the T-shaped section of the corner connection member shown in FIG. 2 may be produced by producing first a corresponding T section of the type shown in FIG. 2, usually by an extrusion process, and cutting this section thereafter to the desired length, the height of each connection piece 21 obtained in this manner corresponding substantially to the distance between the stump-like projections 18*a*, the distance between the stump-like projections 18*a*, 19*a*; 18*b*, 19*b* and 20*a*, 20*b*.

For implementing an intersection between longitudinal and transverse supporting rails, or vice versa, a rail section of the type of which a cross-sectional view is shown in FIG. 1 is moved laterally towards an exactly identical rail section until its forward edge 25 comes to lie flush against one of the laterally projecting supporting webs 13*a*, 13*b*. Prior to moving the left-hand longitudinal rail of FIG. 1, the central mounting web 22 of the connection element corresponding to FIG. 2 has been introduced into the inner longitudinal hollow space 12 of the vertical main web 11 of the transverse supporting rail 26 (which is viewed from the side in FIG. 1), until the shoulder 24 has come to abut against the front surface of the vertical main web 11 of the rail 26. The connection element 21 is then fixed in this abutting position, preferably by fitting a transverse bolt 27 in bores provided in aligned arrangement in the two partial walls 11*a*, 11*b* and the narrower portion 22*b* of the mounting web. Conveniently, these bores may be drilled already in the factory. Given the fact that the thicker portion 22*a* has practically the same width as the vertical main web, the corner connection and/or connection element forms the continuation of the said main web until the two base webs 23*a*, 23*b* of the connection element rest flush against the adjacent outer surface of a partial wall of the vertical main web 11 of the longitudinal rail 10, i.e. in the representation of FIG. 1 against the outer wall of the partial wall 11*b*. That is, since the height of element 24 is equal to the distance "A", the webs 23*a*, 23*b* will lie flush against the wall 11*b*. It is then only necessary to connect one or, preferably, both base webs 23*a*, 23*b* with the corresponding partial wall of the vertical main web, at a predetermined point, for example at 28, and preferably at the top and the bottom. This connection is, preferably, effected by screwing, although other connection methods, for example by means of hollow rivets or the like, are also possible.

Such a connection is absolutely safe against torsion or tilting because the central mounting web 22 fits snugly into the longitudinal hollow space 12 and abuts against the upper and lower intermediate webs 20*a*, 20*b* so that it is absolutely prevented from tilting, while the screw connections provided at the top and the bottom between the two base webs and the perpendicularly extending rail section ensure an absolute safe connection, free from torsion and tilting.

An additional advantage achieved in this manner is seen in the fact that due to the bolt connection indicated at 27, it is possible by tightening the screw connections indicated at 28, i.e. by pulling the base webs towards the corresponding outer abutment surfaces of the vertical main web of the perpendicularly extending rail section, to compress the connection point 25 firmly and, if desired, in a gas-tight manner and to ensure that the counter-ceiling produced in this manner will not open up, not even if walked on.

Figure 4:
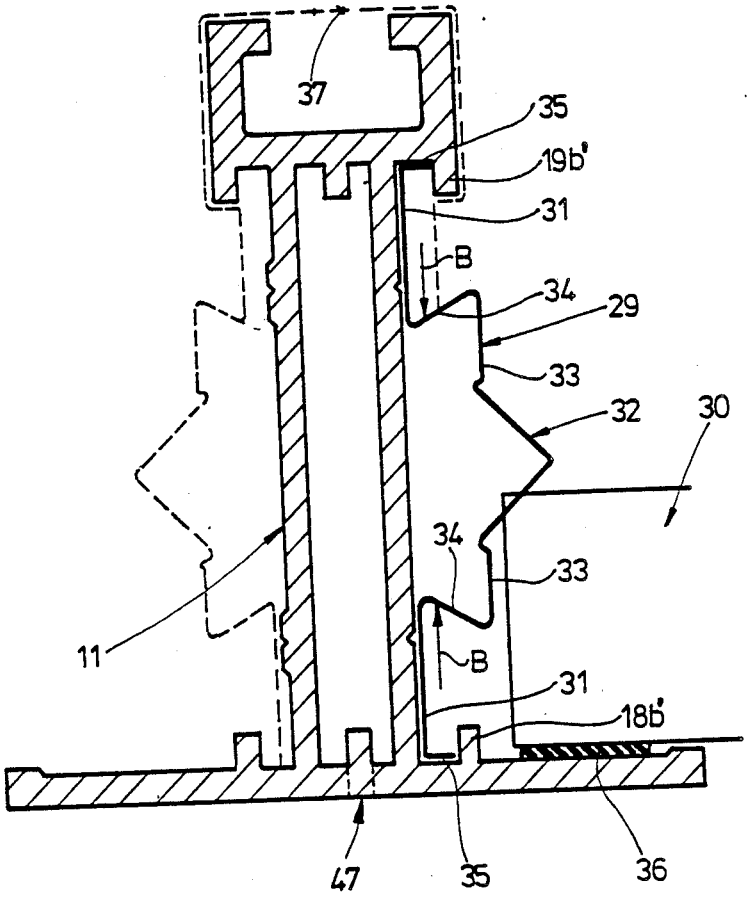
FIG. 4 shows a cross-sectional representation of the basic rail, supplemented by a tensioning spring fitted in the outer profile for retaining coffers or other elements, including filters, mounted in the interspaces between the longitudinal and the transverse supporting rails.

Another advantageous embodiment of the present invention is represented in FIG. 4 and consists in the fact that it is possible, simply by inserting leaf-spring clamps 29 of a suitable cross-section, to click in coffers of any desired shape—indicated at 30—between the respective longitudinal and transverse supporting rails and to retain them in this position by clamping force.

To this end one clicks in initially leaf-spring clamps 29 at a predetermined point of the double U-shaped outer hollow space formed on each side of the vertical main web 11 by the outer surfaces of each partial web 11*a*, 11*b*, in combination with the short web sections 18*a*, 19*a* or 18*b*, 19*b* extending at a certain distance in parallel thereto. It will be easily seen that in the case of such a configuration of the section—which is, however, described only by way of example—a leaf-spring clamp 29 having the shape illustrated in FIG. 4 can be clicked into place safely and undetachably by gripping the leaf-spring clamp first with suitable grippers and compressing it in the direction indicated by the two arrows B, B' until the vertical legs 31 engage behind the projecting short web sections 18*b'*, 19*b'*. The clamp is now firmly retained in position, but can be deformed elastically in the area of its point 32 which exhibits a generally triangular shape. The two flanks of the point 32 end on both sides in short vertical spring sections 33 which are followed by legs 34 which are bent off inwardly at an acute angle and which are in turn followed by the vertical legs 31, which are again bent off at an acute angle and end finally in horizontal short projections 35.

Such a configuration of the leaf springs makes it possible to insert them in advance into the outer profile of the main web and to fit the coffer 30 thereafter by lowering it simply from above until its comes to rest initially on the one upper inclined face of the point 32. A short abrupt downward movement of the coffer will then cause the point 32 to give way so that the respective coffer 30 will click into place and will be secured in this position on all sides within the square or rectangular space between the longitudinal or transverse rails, by the point 32 returning to its original position. The contact zones of the supporting legs may also be provided with seals 36.

It is understood that—as indicated by dashed lines in FIG. 4—the leaf-spring clamps provided on both sides may also be formed as one piece and extend over the whole outer surface of the vertical main web, including the upper surface. In this case, one can under certain circumstances do without the mounting nuts 17 if the spring material is sufficiently strong and the threaded mounting rods can be screwed directly into a threaded passage opening 37 provided in this combined leaf-spring clamp.

Figure 3:
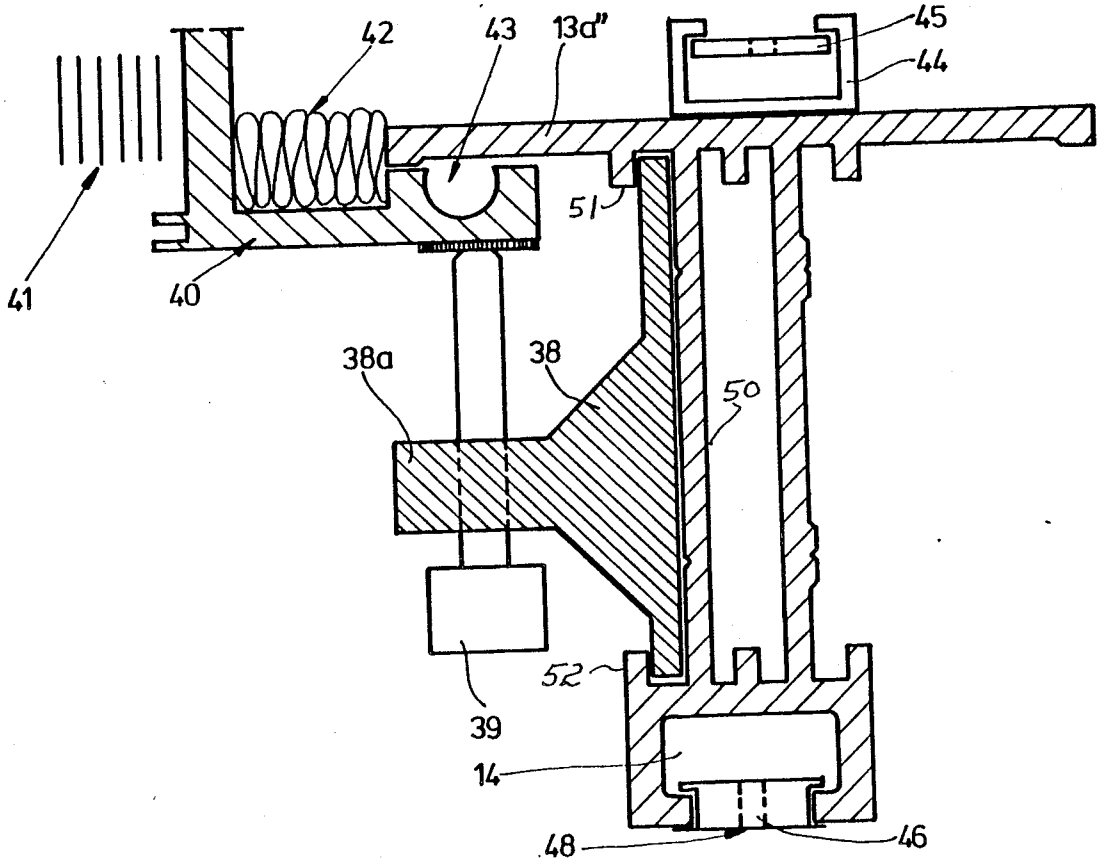
FIG. 3 shows a variant of the present invention with the basic rail suspended in inverse arrangement, preferably for mounting filter inserts or filter panels from below.

Another advantageous embodiment of the present invention is represented in FIG. 3 and consists in the fact that the configuration of the outer profile of the vertical main web 11 is suited not only for receiving and securing in place corresponding leaf-spring clamps—as shown in FIG. 4—but may accommodate also other mounting inserts 38, consisting for example of a suitable metal or plastic material, which can be introduced laterally from the front and are then embraced snugly by the U-shaped spacing profile formed by elements 50, 51. Another U-shaped spacing profile is formed by elements 50, 52. The U-shaped spaces are opposed to each other. Such an embodiment is found to be of particular advantage in cases where the circumstances are such that filters, for example, can be inserted only from below (as intermediate elements, or as replacement for the coffers). The mounting inserts comprise a projection 38*a* with a thread through which a thrust bolt 39 can be screwed from below for pressing a (gutter-shaped) holding frame for a filter—indicated at 40—against one of the two lateral legs 13*a''* which are now in the upper position. The filter itself is indicated only diagrammatically at 41. Sealing can be effected by means of a liquid seal indicated at 42, for example by VASELINE petroleum jelly, while the at least partially circular hollow space indicated at 43 accommodates a dry seal, for example a rubber cord or the like. The connection to the corresponding transverse rail section can be effected as described above, except that for mounting the arrangement to the raw ceiling a separate mounting rail has to be provided which receives a nut 45 by its usual U-shaped profile. The downwardly open hollow section 14 may be covered by an insert 48.

In both cases, threaded bores may be provided at the bottom of the rail section, in particular in the area of the vertical main web, as indicated at 47 in FIG. 4, or in the insert 48 as indicated at 46 in FIG. 3, as sufficient space is available at these points so that additional lamps or, for example, partition walls can be fixed and retained safely on such a counter-ceiling.

All features described in the specification and the following claims and shown in the drawing may be essential to the invention either individually or in any combination thereof.

I claim:

1. A counter ceiling comprising a suspended ceiling supporting formed of a skeleton comprising longitudinal and transverse rails of substantially the same T-shaped cross section, and means for making flush joints between said longitudinal and transverse rails at their points of intersection, whereby each of said longitudinal and transverse rails includes a vertical main web, lower supporting webs projecting sidewise and an enclosed longitudinally extending passage within said main web, and having at least one open end, and connection elements each having a T-shape in cross section, each one of said connection elements having a central mounting web sized and positioned to be received within said passage through said open end in said main web, and laterally extending base webs connected to said central mounting web, said base web being adapted to abut against said vertical main web of a transversely extending rail and to be connected thereto to join together transversely and longitudinally extending rails, said connection element being further arranged such that a front surface of said transversely extending rails are in flush abutment with the outer lateral surfaces of said lower supporting webs.

2. Counter-ceiling according to claim 1, wherein the passage in the vertical main web (11) is formed by two spaced parallel partial webs whose upper portions end in an upper end plate and supporting webs projecting from both sides of the lower portions of said partial webs for supporting ceiling elements projecting laterally form the vertical web.

3. Counter-ceiling according to claim 2, characterized in that aligned short web sections (18*a*, 19*a*; 18*b*, 19*b*) project towards each other from the supporting webs (13*a*, 13*b*), on both sides of each vertical main web (11) and at identical spacing from the upper end plate (15), to form on each side of each vertical main web (11) opposed U-shaped hollow spaces with a large opening.

4. Counter-ceiling according to claim 3, and a mounting insert received in at least one of said U-shaped hollow spaces on at least one side of said vertical main web, said insert including a projection supporting mounting means therein for mounting a filter thereon.

5. Counter-ceiling according to claim 4, characterized in that said mounting means includes a mounting screw (39) operable to press a filter frame (40) against a supporting web (13*a''*) in spaced relation thereto for accommodating a seal.

6. Counter-ceiling according to claim 4, characterized in that a separate mounting rail (44) is connected to the bottom of said support rail for receiving nuts for mounting the arrangement on the raw ceiling in inverted position.

7. Counter-ceiling according to claim 2, characterized in that said passage includes top and bottom walls, and inwardly directed intermediate webs (20*a*, 20*b*) are arranged in said passage on the top and the bottom walls, the height of said intermediate webs being equal to the height of the short web sections.

8. Counter-ceiling according to claim 2, characterized in that the central mounting web (22) of the connection element (21) comprises a thicker portion (22*a*) adjacent the base webs and a narrower portion attached thereto.

9. Counter-ceiling according to claim 8, characterized in that the height of the thicker portion of the central mounting web (22) of the connection element (21) is substantially equal to the distance between the outer surface of each supporting web (13*a*, 13*b*) and the adjacent outer surface of the vertical main web (11) of the rail section (10).

10. Counter-ceiling according to claim 3, characterized in that the width of the connection element (21) is substantially equal to the clear distance between the short web sections (18*a*, 18*b*; 19*a*, 19*b*) forming the U-shaped hollow spaces on both sides of the vertical main web (11), whereby the base webs (23*a*, 23*b*) of the connection element (21) are introduced into said hollow spaces until said base webs come to rest against the outer surface of the vertical main web so they can be fixed in place.

11. Counter-ceiling according to claim 10, characterized in that upper and lower screw connections (28) are provided for connecting the base webs (28*a*, 23*b*) of the connection element to the adjacent surface of the vertical main web (11) of a perpendicularly extending supporting rail.

12. Counter-ceiling according to claim 2, characterized in that the upper end plate (15) of each vertical main web (11) is provided with an upwardly open recess for receiving nuts (17) adapted to receive threaded supporting rods fixed to a raw ceiling.

13. Counter-ceiling according to claim 2, characterized in that mounting bores are provided at the bottom of said main web between the two partial webs (11*a*, 11*b*).

14. Counter-ceiling according to claim 3, and resilient leaf-spring clamps (29) in said U-shaped hollow spaces on both sides of each vertical main web (11), said clamps comprising a pointed portion resiliently connected to the remainder of said clamp, whereby said pointed portion is adapted to receive and secure in place coffers (30) resting on the supporting webs (13*a*, 13*b*) of each supporting rail.

15. Counter-ceiling according to claim 14, characterized in that each leaf-spring clamp includes end portions received in the space defined by the vertical short web sections (18*b*′, 19*b*′) which extend in parallel to each vertical main web (11), said end portions resiliently supporting said pointed portion (32) whereby said pointed portion deflects when coffers (30) are pressed in and locks the coffer thereafter in place by returning resiliently to its original position.

16. Counter-ceiling according to claim 14, characterized in that each leaf-spring clamp comprises a pointed portion (32) connected to respective vertical spring portions (33) from which a respective first leg extends at an acute angle, said first legs being connected to a respective second leg (31) which rest against matching partial surfaces on the outside of each vertical main web (11), said second vertical legs (31) ending in short projections (35) serving to lock the leaf-spring clamp in the respective hollow space formed by the short web sections (18*b*, 19*b*).

17. Counter ceiling according to claim 14, characterized in that the leaf-spring clamps provided on both sides of said main web and serving for securing the coffers, or the like, form one single-piece combined leaf-spring clamp following the basic shape of the vertical main web (11) and extending around the main web upper portion.

18. A counter ceiling as in claim 1, and a transverse bolt extending through said central mounting web and said main web to maintain said central mounting web within said passage.

* * * * *